US012752961B2

(12) United States Patent
Hajek et al.

(10) Patent No.: US 12,752,961 B2
(45) Date of Patent: Oct. 6, 2026

(54) SHIPPING AND DISPENSING CONSTRUCT

(71) Applicant: Graphic Packaging International, LLC, Atlanta, GA (US)

(72) Inventors: Ronald E. Hajek, Joliet, IL (US); Sharon Weaver, Chicago, IL (US); Dana Exner, Wheaton, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 79 days.

(21) Appl. No.: 17/354,468

(22) Filed: Jun. 22, 2021

(65) Prior Publication Data

US 2021/0403198 A1 Dec. 30, 2021

Related U.S. Application Data

(60) Provisional application No. 63/043,192, filed on Jun. 24, 2020.

(51) Int. Cl.
*B65D 5/72* (2006.01)
*B65D 5/54* (2006.01)

(52) U.S. Cl.
CPC ..... *B65D 5/725* (2013.01); *B65D 5/542* (2013.01); *B65D 2517/0008* (2013.01)

(58) Field of Classification Search
CPC ... B65D 5/725; B65D 5/542; B65D 251/0008
USPC ..... 221/305
See application file for complete search history.

(56) References Cited

U.S. PATENT DOCUMENTS 396,570 A 1/1889 Hotchkiss
637,838 A 11/1899 Vernon
1,373,365 A 3/1921 Smouse
1,833,605 A 11/1931 Gates, Jr.
1,892,756 A 1/1933 Van Home
2,330,521 A 9/1943 Scheide
(Continued)

FOREIGN PATENT DOCUMENTS

CA 1079240 6/1980
EP 0 060 504 B1 11/1984
(Continued)

OTHER PUBLICATIONS

Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray.

(Continued)

*Primary Examiner* — Rakesh Kumar
(74) *Attorney, Agent, or Firm* — Andrew N. Claerbout; FisherBroyles, LLP

(57) ABSTRACT

A shipping and dispensing construct for engaging a plurality of product holding containers. The shipping and dispensing construct can comprise a plurality of panels comprising at least a front panel, a first side panel, a back panel, and a second side panel. Attachment features can be for attaching the shipping and dispensing construct to the plurality of product holding container. The attachment features can be in one or more panels of the plurality of panels. Dispensing features can be for removal of respective product holding containers of the plurality of product holding containers from the shipping and dispensing construct. The dispensing features can be in one or more panels of the plurality of panels.

17 Claims, 5 Drawing Sheets

(56) References Cited

U.S. PATENT DOCUMENTS 2,341,762 A 2/1944 Conklin
2,355,729 A 8/1944 Inman
2,355,730 A 8/1944 Inman
2,359,986 A 10/1944 Grecco
2,558,713 A 6/1951 Williamson
2,662,684 A 12/1953 Robins
2,671,584 A 3/1954 Taylor, Jr.
2,684,178 A 7/1954 Keeler
2,723,027 A 11/1955 Reynolds
2,811,250 A 10/1957 Arneson
2,846,062 A 8/1958 Paige
2,872,036 A 2/1959 Forrer
2,888,132 A * 5/1959 Guyer ..... B65D 5/5445 206/820
3,027,063 A 3/1962 Zastrow
3,056,528 A 10/1962 Shiels, Jr.
3,071,244 A 1/1963 Doran
3,127,991 A * 4/1964 Burnett ..... B65D 5/542 206/820
3,136,410 A 6/1964 Sanford
3,144,190 A 8/1964 Holt
3,158,312 A 11/1964 Simkins
3,163,351 A 12/1964 Borgardt
3,186,587 A 6/1965 Englander
3,195,850 A 7/1965 Steiner
3,263,807 A * 8/1966 Fingerhut ..... B65D 75/66 229/238
3,315,875 A * 4/1967 Praetorius ..... B65D 5/16 229/242
3,323,639 A 6/1967 Krzyzanowski
3,324,999 A 6/1967 Farquhar
3,326,369 A * 6/1967 Tolaas ..... B65D 5/542 206/499
3,355,089 A 11/1967 Champlin
3,375,968 A 4/1968 Weiss
3,392,878 A * 7/1968 Jackson ..... A47F 1/08 221/307
3,447,735 A 6/1969 Whitney
3,493,106 A 2/1970 Galli
D217,441 S 5/1970 Kanaga
3,528,598 A 9/1970 Lock
3,635,393 A 1/1972 Herglotz
3,677,458 A * 7/1972 Gosling ..... B65D 5/4608 206/192
3,756,502 A * 9/1973 Swanson ..... B65D 5/542 229/122
3,840,171 A 10/1974 Waters
3,840,172 A 10/1974 Zimmermann
3,872,965 A 3/1975 Taub
3,886,901 A 6/1975 Zeitter
3,918,584 A 11/1975 Richardson
3,935,943 A 2/1976 Meyer
3,949,928 A 4/1976 Perkins
4,068,795 A 1/1978 Forster
4,082,215 A 4/1978 Eichenauer
D250,093 S 10/1978 Schillinger
4,170,325 A * 10/1979 Pawlowski ..... B65D 5/725 221/311
4,192,445 A 3/1980 Card
4,252,236 A * 2/1981 Roccaforte ..... B65D 5/725 229/230
4,277,015 A 7/1981 Crane
D260,076 S 8/1981 Schillinger
4,328,923 A 5/1982 Graser
4,340,169 A 7/1982 Webinger
4,415,082 A * 11/1983 Martin ..... B65D 5/46016 229/117.14
4,449,633 A 5/1984 Johnson et al.
D281,484 S 11/1985 Dickes
4,671,451 A 6/1987 Yeaman, Sr.
4,696,402 A * 9/1987 Harmon ..... B65D 71/14 206/703
4,790,436 A * 12/1988 Nakamura ..... B65D 83/0805 229/125.17
4,794,005 A 12/1988 Swiontek
4,817,866 A 4/1989 Wonnacott
4,860,944 A 8/1989 Wonnacott
4,865,187 A * 9/1989 Zulauf ..... B65D 5/54 229/122
4,895,295 A 1/1990 Montgomery
D306,699 S 3/1990 Michau
4,905,837 A 3/1990 Schuster et al.
4,928,817 A 5/1990 Focke
4,930,633 A 6/1990 Gloyer
4,944,405 A * 7/1990 Buford ..... B65D 5/48008 229/160
4,961,501 A 10/1990 Hansmann
5,016,813 A 5/1991 Simons
5,020,663 A * 6/1991 Dallas ..... B65D 5/725 229/122
5,044,503 A * 9/1991 Wein ..... B65D 5/705 229/125.09
5,048,687 A * 9/1991 Suzuki ..... B65D 75/5833 229/87.05
D320,557 S 10/1991 Schuster
5,060,804 A * 10/1991 Beales ..... B65D 71/36 229/103.1
5,094,359 A 3/1992 DeMars et al.
5,125,565 A 6/1992 Rogers
5,170,934 A 12/1992 Lemoine
5,181,607 A * 1/1993 Focke ..... B65D 5/5495 206/192
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,505,369 A 4/1996 Taliaferro
5,520,284 A 5/1996 Gray
5,522,538 A 6/1996 Gray
5,570,808 A * 11/1996 Tassoni ..... B65D 83/0805 221/311
5,590,813 A * 1/1997 Abramczyk ..... B65D 83/08 229/122.2
5,607,056 A 3/1997 Whiteside
5,675,960 A 10/1997 Weaver
5,730,353 A * 3/1998 Holley, Jr. ..... B65D 59/04 229/242
5,823,350 A * 10/1998 Ward ..... B65D 75/54 340/572.1
5,871,090 A * 2/1999 Doucette ..... B65D 71/02 294/87.2
5,871,100 A * 2/1999 Ward ..... H01M 50/213 340/572.1
6,041,997 A 3/2000 Jensen
6,126,065 A 10/2000 Wee
6,155,412 A 12/2000 Le Bras
6,305,598 B1 10/2001 Bryan
D458,127 S 6/2002 De Groote
D467,499 S 12/2002 Garza et al.
D473,787 S 4/2003 Jones, Jr. et al.
6,554,135 B1 4/2003 Luceri
D478,737 S * 8/2003 Sparkowski ..... D7/515
D484,043 S 12/2003 Hwang et al.
D484,799 S 1/2004 Hoffman
6,676,010 B1 1/2004 Roseth et al.
D486,390 S 2/2004 Auclair
6,729,475 B2 5/2004 Yuhas et al.
D495,953 S 9/2004 Miller
6,808,107 B2 10/2004 Jackson
D505,620 S 5/2005 Huebsch
6,938,818 B2 9/2005 Moorman
6,981,631 B2 1/2006 Fogle et al.
D515,942 S 2/2006 Hamblin
D519,366 S 4/2006 Epstein
7,021,525 B2 4/2006 Jouppi et al.
D519,830 S 5/2006 Yocum
7,097,041 B2 8/2006 Marrale
7,234,593 B2 * 6/2007 Fath ..... B65D 5/422 206/459.5
D561,023 S 2/2008 Jacxsens

(56) References Cited

U.S. PATENT DOCUMENTS 7,380,701 B2 * 6/2008 Fogle ..... B65D 71/34 206/431
D590,244 S 4/2009 Demalsche
7,552,820 B2 6/2009 Kohler
7,624,911 B2 12/2009 Spurrell
7,669,755 B2 3/2010 Smalley
7,699,214 B2 4/2010 Mestre et al.
D622,589 S 8/2010 Elias
D629,296 S 12/2010 De Muynck
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
D637,078 S 5/2011 Peng
7,938,257 B2 5/2011 Kohler
8,028,839 B2 10/2011 Learn
D656,394 S 3/2012 Smith
D666,830 S 9/2012 Glenn
D668,533 S 10/2012 Collins
D684,858 S 6/2013 Sill
8,701,974 B2 * 4/2014 Davies ..... B65D 5/542 229/102
D706,129 S 6/2014 Boraczek
8,740,050 B2 6/2014 Zinck et al.
D713,725 S 9/2014 Cedeno
D714,149 S 9/2014 Cedeno
D717,162 S 11/2014 Baker
D719,018 S 12/2014 Levy
9,033,209 B2 5/2015 Fogle et al.
9,073,658 B2 7/2015 Spivey, Sr. et al.
D741,175 S 10/2015 Amindjanov
9,162,793 B2 * 10/2015 Stewart ..... B65D 5/542
9,169,037 B2 10/2015 Pinkstone
9,211,971 B2 12/2015 Fogle et al.
9,248,933 B2 2/2016 Spivey, Sr. et al.
D753,994 S 4/2016 Pantelleria
9,309,023 B2 4/2016 Hubbard, Jr.
9,321,553 B1 4/2016 Spivey, Sr. et al.
D755,624 S 5/2016 Ng
9,346,234 B2 5/2016 Hajek et al.
D762,468 S 8/2016 Pantelleria et al.
D764,271 S 8/2016 Sanfilippo
D769,114 S 10/2016 Montemayor
9,505,516 B2 11/2016 Hubbard, Jr.
D775,947 S 1/2017 Epstein
9,701,438 B2 7/2017 Fitzwater et al.
D805,894 S 12/2017 Lee
9,845,182 B2 12/2017 Baldino
D809,930 S 2/2018 Kagawa
D810,561 S 2/2018 Garnett
D811,875 S 3/2018 Haen et al.
D813,029 S 3/2018 Borkovetz et al.
D814,296 S 4/2018 Collins
10,017,290 B2 7/2018 Faulkner et al.
10,086,972 B2 10/2018 Hajek
D834,411 S 11/2018 Vanderhulst
D838,587 S 1/2019 Laliberte
D842,695 S 3/2019 Haen
10,232,973 B2 3/2019 Burke
10,239,651 B2 3/2019 Exner et al.
D848,835 S 5/2019 Exner
D861,484 S 10/2019 Patel
D864,751 S 10/2019 Exner
D864,753 S 10/2019 Exner
D866,321 S 11/2019 Bennett
D880,999 S 4/2020 Sill
D887,830 S 6/2020 Kirchen
D891,917 S 8/2020 Candan
D897,839 S 10/2020 Vanderhulst
D899,922 S 10/2020 Sanfilippo
D901,241 S 11/2020 Cohen
D904,870 S 12/2020 Sill
D912,508 S 3/2021 Kirchen
D917,279 S 4/2021 Blomberg
D918,030 S 5/2021 Wan
D918,036 S 5/2021 David
D920,099 S 5/2021 Stabile
D923,473 S 6/2021 Jacobsson
D939,340 S 12/2021 Moffat
11,203,460 B2 12/2021 Hokanson
D949,010 S 4/2022 Sill
D966,098 S 10/2022 Gonzalez Manzano
D968,952 S 11/2022 Chambers
D974,906 S 1/2023 Vanderhulst
D975,540 S 1/2023 Castro
D996,207 S 8/2023 Weaver
D996,214 S 8/2023 Genord
11,807,432 B2 11/2023 Weaver
D1,009,621 S 1/2024 Houkom
D1,018,297 S 3/2024 Mayer
D1,018,298 S 3/2024 Ackroyd
D1,023,746 S 4/2024 Pinkstone
D1,028,705 S 5/2024 Tipping
D1,029,630 S * 6/2024 Hajek ..... D9/432
2004/0031842 A1 2/2004 Westerman et al.
2004/0182916 A1 9/2004 Roseth
2004/0226988 A1 11/2004 Fogle
2004/0245327 A1 12/2004 Oliff
2005/0045706 A1 3/2005 Varanasi
2005/0056554 A1 * 3/2005 Fath ..... B65D 85/1072 206/242
2005/0092649 A1 5/2005 Ford
2005/0279815 A1 12/2005 Fogle et al.
2006/0054671 A1 3/2006 Galkoski
2006/0151585 A1 7/2006 Misjak
2006/0255105 A1 11/2006 Sweet
2006/0283928 A1 * 12/2006 Walsh ..... B65D 5/744 493/51
2007/0095881 A1 5/2007 Manaige
2007/0141208 A1 6/2007 Nukuto
2007/0295796 A1 12/2007 Sutherland
2008/0087679 A1 4/2008 Cook
2008/0277311 A1 11/2008 Wang
2009/0039144 A1 2/2009 Hooi et al.
2009/0302098 A1 12/2009 Learn
2010/0108748 A1 5/2010 Fleming
2011/0215110 A1 9/2011 Kadhum
2011/0226847 A1 9/2011 Nakano
2011/0274880 A1 11/2011 Gotschi
2012/0273387 A1 * 11/2012 Ivosevic ..... B65B 17/02 156/305
2012/0298732 A1 * 11/2012 Stewart ..... B65D 5/542 229/122
2013/0112592 A1 * 5/2013 Bowers ..... B31B 50/142 206/774
2013/0140350 A1 6/2013 Noferi
2013/0334096 A1 12/2013 Fath
2014/0096488 A1 * 4/2014 Gonzalez ..... B65D 71/36 206/427
2014/0263600 A1 9/2014 Valencia
2015/0083625 A1 * 3/2015 Paredes ..... B65D 71/36 206/427
2016/0101917 A1 4/2016 Spivey, Sr.
2016/0176569 A1 6/2016 Hanke
2017/0267397 A1 9/2017 Cooper
2017/0297796 A1 10/2017 Ball
2019/0291932 A1 9/2019 Chevalier
2020/0189818 A1 * 6/2020 McCree ..... B65D 71/46
2020/0207055 A1 7/2020 Wirtz
2021/0016916 A1 1/2021 Ford
2021/0309412 A1 10/2021 Abjean
2021/0362926 A1 11/2021 Gonzalez Manzano
2021/0403198 A1 * 12/2021 Hajek ..... B65D 5/725
2021/0403199 A1 * 12/2021 Weaver ..... B65D 5/542
2021/0403216 A1 * 12/2021 Mills ..... B65B 5/06
2021/0403217 A1 12/2021 Mills
2022/0017259 A1 1/2022 Barbieri
2023/0013072 A1 1/2023 Stiess
2023/0339670 A1 10/2023 Brink
2023/0356868 A1 11/2023 Scapin

(56) References Cited

U.S. PATENT DOCUMENTS

| | | | |
|---|---|---|---|
| 2023/0373675 | A1 | 11/2023 | Telman |
| 2024/0166425 | A1 | 5/2024 | Bugelli |

FOREIGN PATENT DOCUMENTS

| | | | | | |
|---|---|---|---|---|---|
| EP | 0 647 199 | B1 | | 5/2000 | |
| EP | 1 348 638 | A1 | | 10/2003 | |
| EP | 1200316 | B1 | * | 6/2004 | ..... B65D 71/16 |
| EP | 2 008 937 | A1 | | 12/2008 | |
| EP | 2 493 772 | B1 | | 6/2014 | |
| GB | 2387591 | A | * | 10/2003 | ..... B65D 5/542 |
| JP | 3062562 | U | | 10/1999 | |
| JP | 2004-123101 | | | 4/2004 | |
| JP | 2009-073536 | | | 4/2009 | |
| JP | 2011093601 | A | * | 5/2011 | ..... B65D 5/54 |
| KR | 20-0171748 | | | 3/2000 | |
| KR | 200450117 | Y1 | * | 9/2010 | ..... B65D 71/34 |
| WO | WO 89/10308 | | | 11/1989 | |
| WO | WO 95/25046 | A1 | | 9/1995 | |
| WO | WO-9847417 | A1 | * | 10/1998 | ..... A47F 1/08 |
| WO | WO 00/71427 | A1 | | 11/2000 | |
| WO | WO 00/78619 | A2 | | 12/2000 | |
| WO | WO 2010/006629 | A1 | | 1/2010 | |
| WO | WO 2012/148986 | A1 | | 11/2012 | |

OTHER PUBLICATIONS

International Search Report and Written Opinion for PCT/US2021/038434 dated Oct. 19, 2021.
International Search Report and Written Opinion for PCT/US2021/038435 dated Oct. 21, 2021.
International Search Report and Written Opinion for PCT/US2021/038438 dated Oct. 6, 2021.
International Search Report and Written Opinion for PCT/US2021/038427 dated Oct. 18, 2021.
International Search Report and Written Opinion for PCT/US2021/038431 dated Oct. 18, 2021.
U.S. Appl. No. 29/756,578, filed Oct. 29, 2020.
U.S. Appl. No. 29/756,579, filed Oct. 29, 2020.
U.S. Appl. No. 29/756,580, filed Oct. 29, 2020.
U.S. Appl. No. 29/756,581, filed Oct. 29, 2020.
U.S. Appl. No. 29/753,802, filed Oct. 2, 2020.
U.S. Appl. No. 17/354,475, filed Jun. 22, 2021.
U.S. Appl. No. 17/354,486, filed Jun. 22, 2021.
U.S. Appl. No. 17/354,491, filed Jun. 22, 2021.
U.S. Appl. No. 17/354,454, filed Jun. 22, 2021.
Sidel wrap around case packer, posted at sidel.com (date not available), [site visited Oct. 16, 2023]. Available from internet, URL: < https://www.sidel.com/en/overwrapping-packing/wrap-around-blank-packing/cermex-wb-bb-pd-384> (Year: NA).
Supplementary European Search Report for EP 21 82 8680 dated Jun. 21, 2024.
Supplementary European Search Report for EP 21 82 9870 dated Jun. 25, 2024.

* cited by examiner

SHIPPING AND DISPENSING CONSTRUCT

CROSS-REFERENCE TO RELATED APPLICATIONS

This application claims the benefit of U.S. Provisional Patent Application No. 63/043,192, filed on Jun. 24, 2020.

INCORPORATION BY REFERENCE

The disclosures of U.S. Provisional Patent Application No. 63/043,192, which was filed on Jun. 24, 2020, and U.S. Design patent application Ser. No. 29/756,578, which was filed on Oct. 29, 2020, are hereby incorporated by reference for all purposes as if presented herein in their entirety.

BACKGROUND OF THE DISCLOSURE

The present disclosure generally relates to shipping and dispensing constructs and/or cartons for holding and dispensing containers or other types of articles. More specifically, the present disclosure relates to a shipping and dispensing construct for holding and dispensing a plurality of containers such as product holding containers, the shipping and dispensing construct having features to facilitate dispensing one or more of the product holding containers.

SUMMARY OF THE DISCLOSURE

In general, one aspect of the disclosure is directed to a shipping and dispensing construct for engaging a plurality of product holding containers. The shipping and dispensing construct can comprise a plurality of panels comprising at least a front panel, a first side panel, a back panel, and a second side panel. Attachment features can be for attaching the shipping and dispensing construct to the plurality of product holding container. The attachment features can be in one or more panels of the plurality of panels. Dispensing features can be for removal of respective product holding containers of the plurality of product holding containers from the shipping and dispensing construct. The dispensing features can be in one or more panels of the plurality of panels.

In another aspect, the disclosure is generally directed to a construct blank for forming a shipping and dispensing construct for engaging a plurality of product holding containers. The construct blank can comprise a plurality of panels comprising at least a front panel, a first side panel, a back panel, and a second side panel. Attachment features can be for attaching the blank to the plurality of product holding containers. The attachment features can be in one or more panels of the plurality of panels. Dispensing features can be for removal of respective product holding containers of the plurality of product holding containers from the shipping and dispensing construct formed from the construct blank. The dispensing features can be in one or more panels of the plurality of panels.

In another aspect, the disclosure is generally directed to a package that can comprise a shipping and dispensing construct comprising a plurality of panels extending at least partially around an interior of the shipping and dispensing construct, attachment features in one or more panels of the plurality of panels, and dispensing features in one or more panels of the plurality of panels. The package further can comprise a plurality of product holding containers attached to the shipping and dispensing construct at the attachment features. The dispensing features can facilitate removing the product holding containers of the plurality of product holding containers from the package.

In another aspect, the disclosure is generally directed to a method that can comprise obtaining a construct blank comprising a plurality of panels comprising at least a front panel, a first side panel, a back panel, and a second side panel, attachment features in one or more panels of the plurality of panels, and dispensing features in one or more panels of the plurality of panels. The method further can comprise attaching a plurality of product holding containers to the attachment features and forming the construct blank into a shipping and dispensing construct. The dispensing features can facilitate removing the product holding containers of the plurality of product holding containers from the shipping and dispensing construct.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, cartons, carriers, clips, sleeves, or the like, and packages for shipping and dispensing articles such as containers, cartons, constructs, sleeves, etc. that hold a product. The containers can be product holding containers used for packaging consumer products such as soap, but the product holding containers could hold other products such as food and beverage products, or any other suitable product. The product holding containers can be made from materials suitable in composition for packaging the particular consumer product or item, and the materials include, but are not limited to, paperboard, composite paperboard, and the like; plastics such as PET, LDPE, LLDPE, HDPE, PP, PS, PVC, EVOH, and Nylon, or any combination thereof, or any other suitable material.

Constructs according to the present disclosure can accommodate articles of any shape. For the purpose of illustration and not for the purpose of limiting the scope of the disclosure, the following detailed description describes product holding containers (e.g., paperboard cartons having closed ends such as cuboid paperboard boxes) as associated with the shipping and dispensing construct embodiments and/or as disposed within the construct embodiments. In this specification, the terms "inner," "interior," "outer," "exterior," "lower," "bottom," "upper," and "top" indicate orientations determined in relation to fully erected and upright constructs and cartons.

Figure 1:
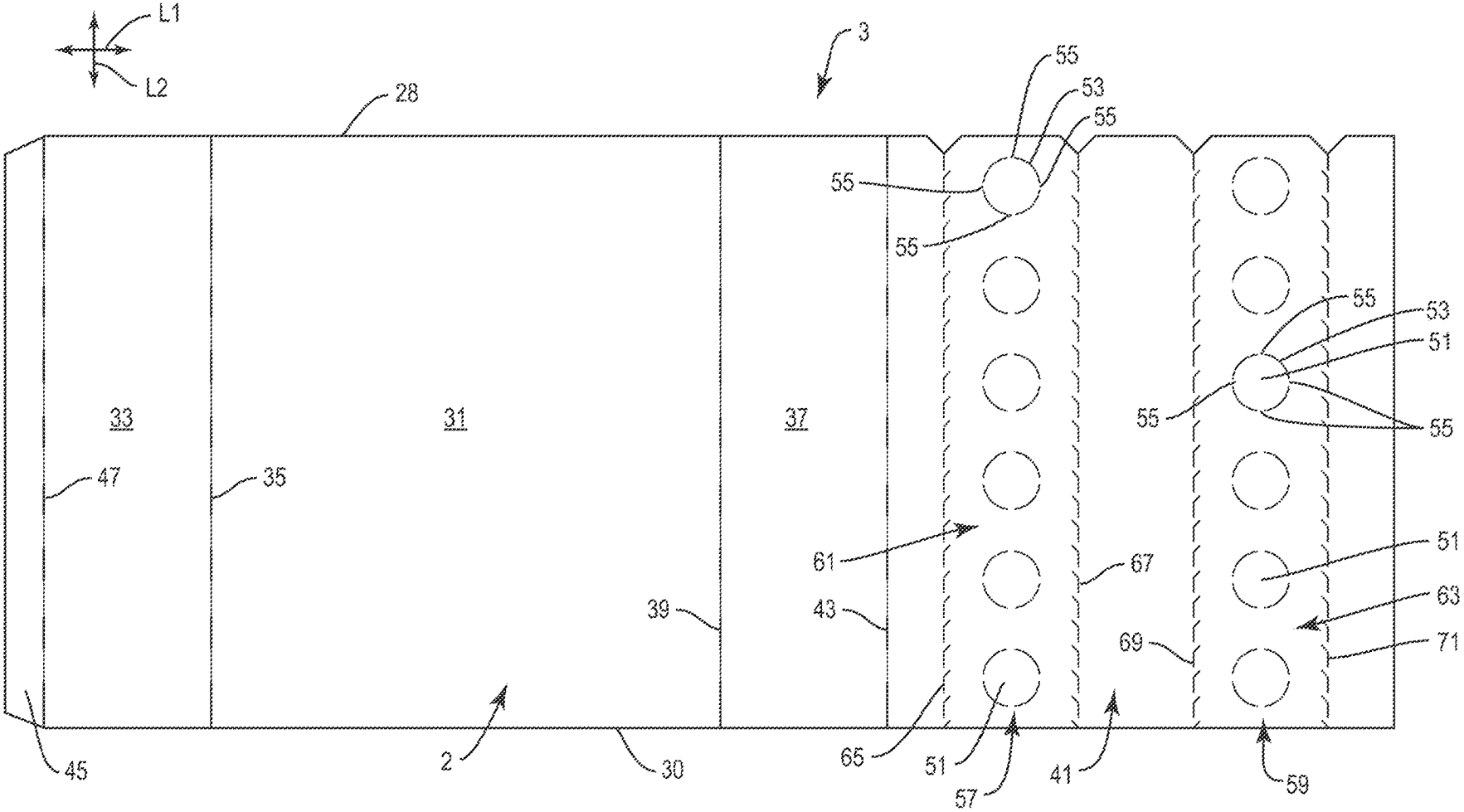
FIG. 1 is an exterior plan view of a construct blank used to form a shipping and dispensing construct according to an exemplary embodiment of the disclosure.

FIG. 1 is a plan view of an exterior surface 2 of a construct blank 3 used to form a shipping and dispensing construct 5 (FIGS. 3-5) according to an exemplary embodiment of the disclosure. The construct 5 can be used to hold a plurality of product holding containers C securely for shipping from the product holding container supplier to a point-of-sale vendor (e.g., department store, grocery store, etc.) where the construct with attached product holding containers can be displayed for purchase by a consumer. In one embodiment, the construct 5 has attachment features for securely attaching the product holding containers to the construct and dispensing features for allowing the respective product holding containers to be released or dispensed from the construct (e.g., by the consumer).

Figure 2B:
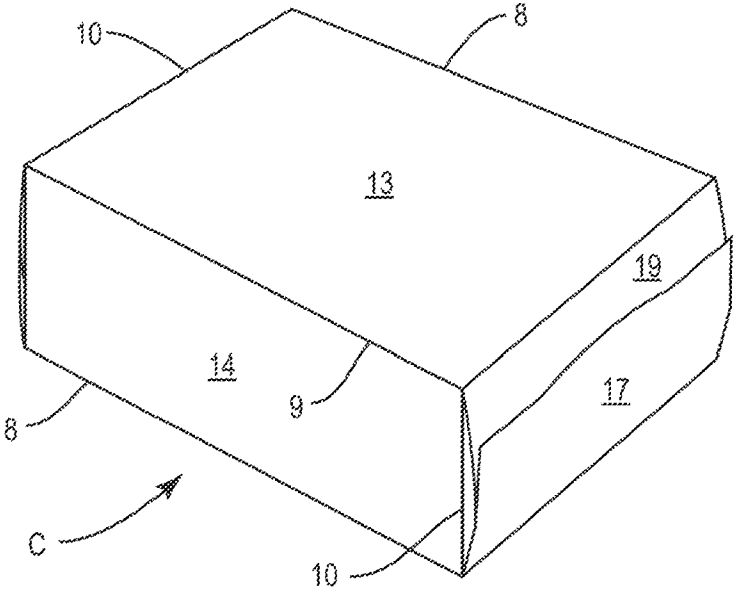
FIG. 2B is a perspective view of the product holding carton formed from the carton blank of FIG. 2A according to the exemplary embodiment of the disclosure.
Figure 2A:
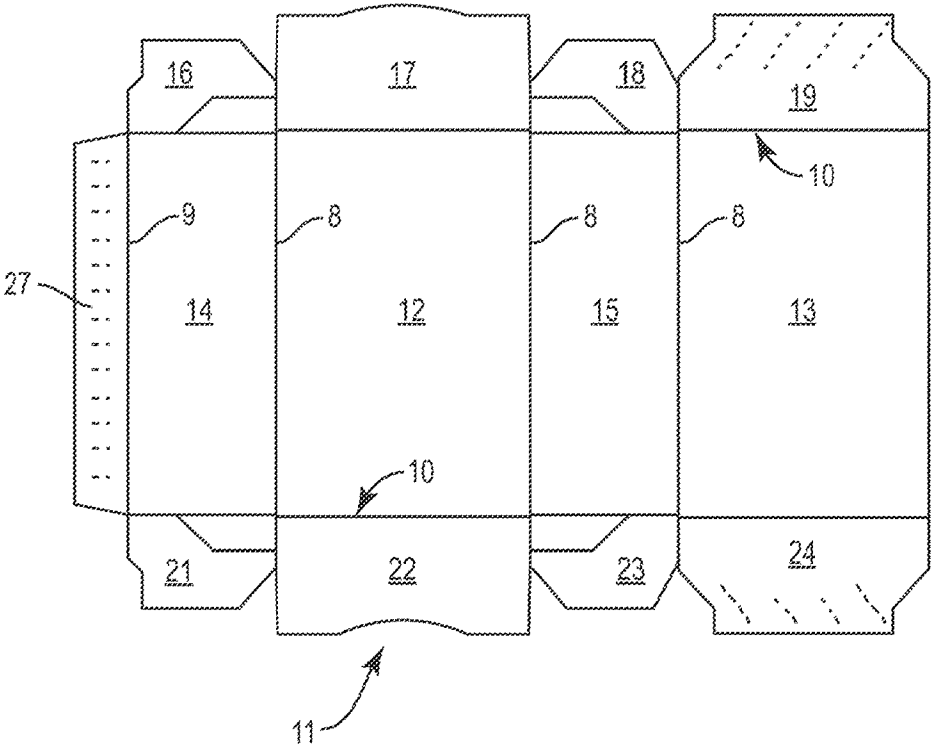
FIG. 2A is an exterior plan view of a carton blank used to form a product holding carton according to the exemplary embodiment of the disclosure.
Figure 3:
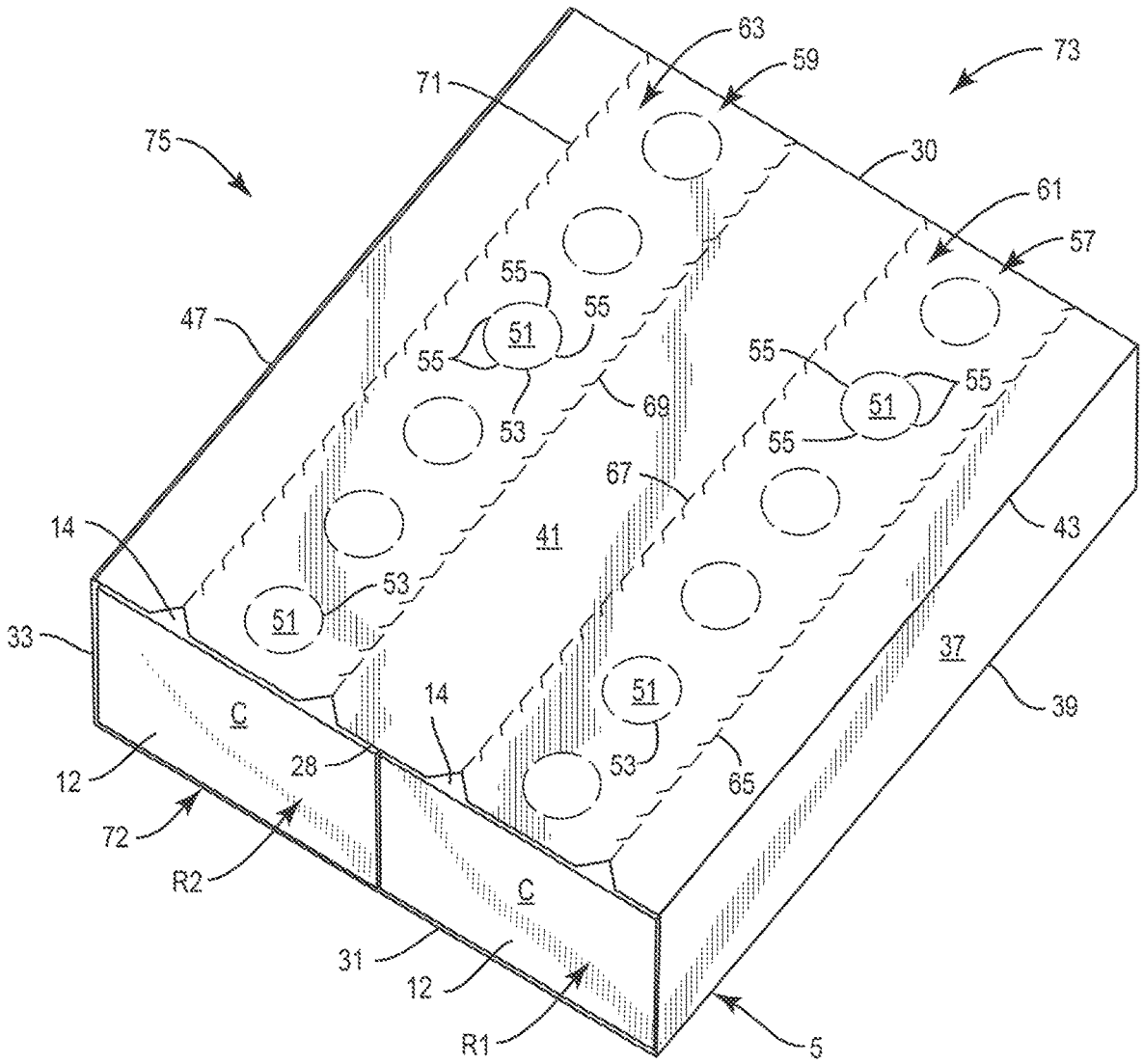
FIG. 3 is a perspective view of a package including the shipping and dispensing construct formed from the construct blank of FIG. 1 and a plurality of product holding containers of FIG. 2B according to the exemplary embodiment of the disclosure.
Figure 4:
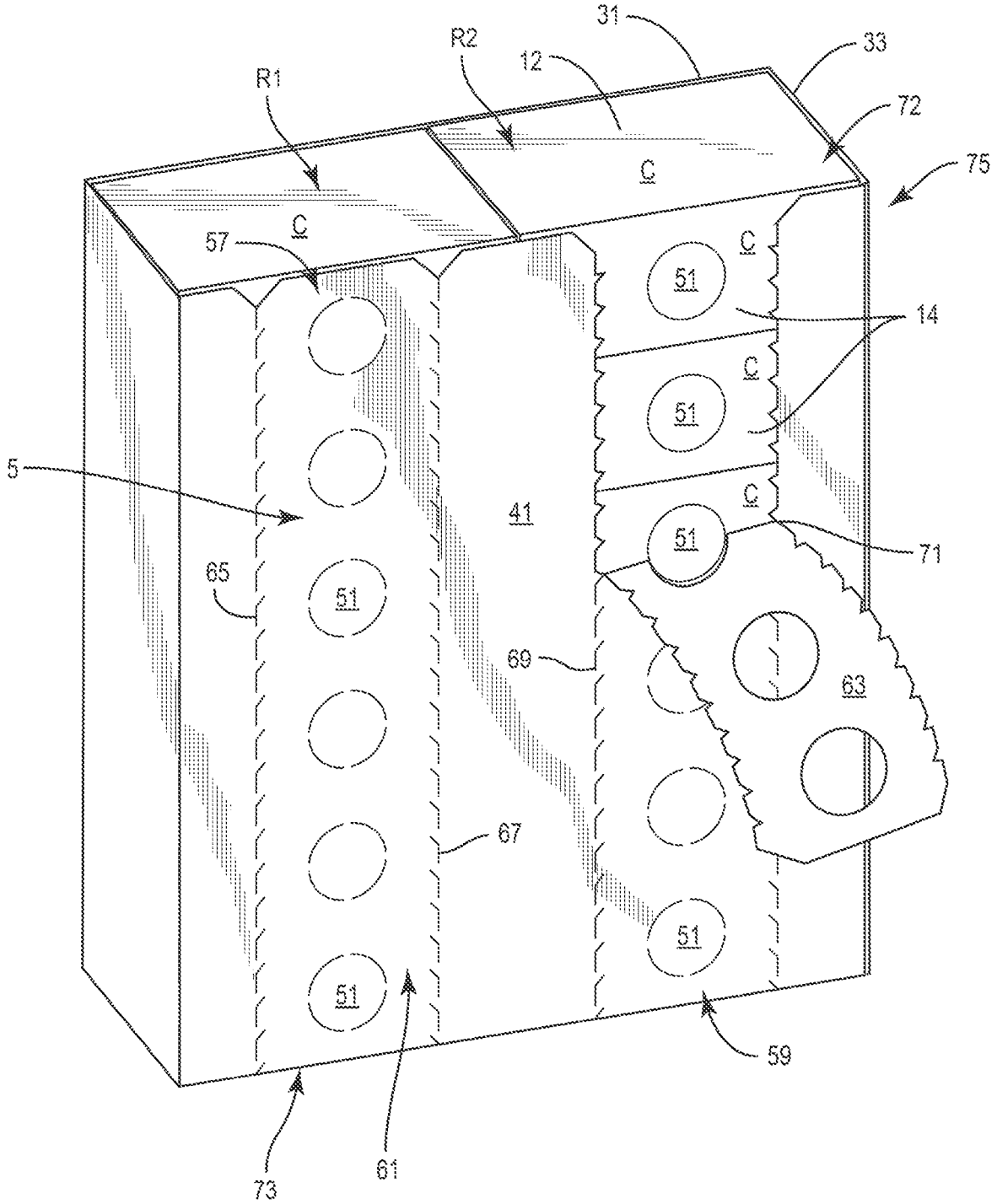
FIG. 4 is a perspective view of the package of FIG. 3 with a dispensing feature partially removed according to the exemplary embodiment of the disclosure.
Figure 5:
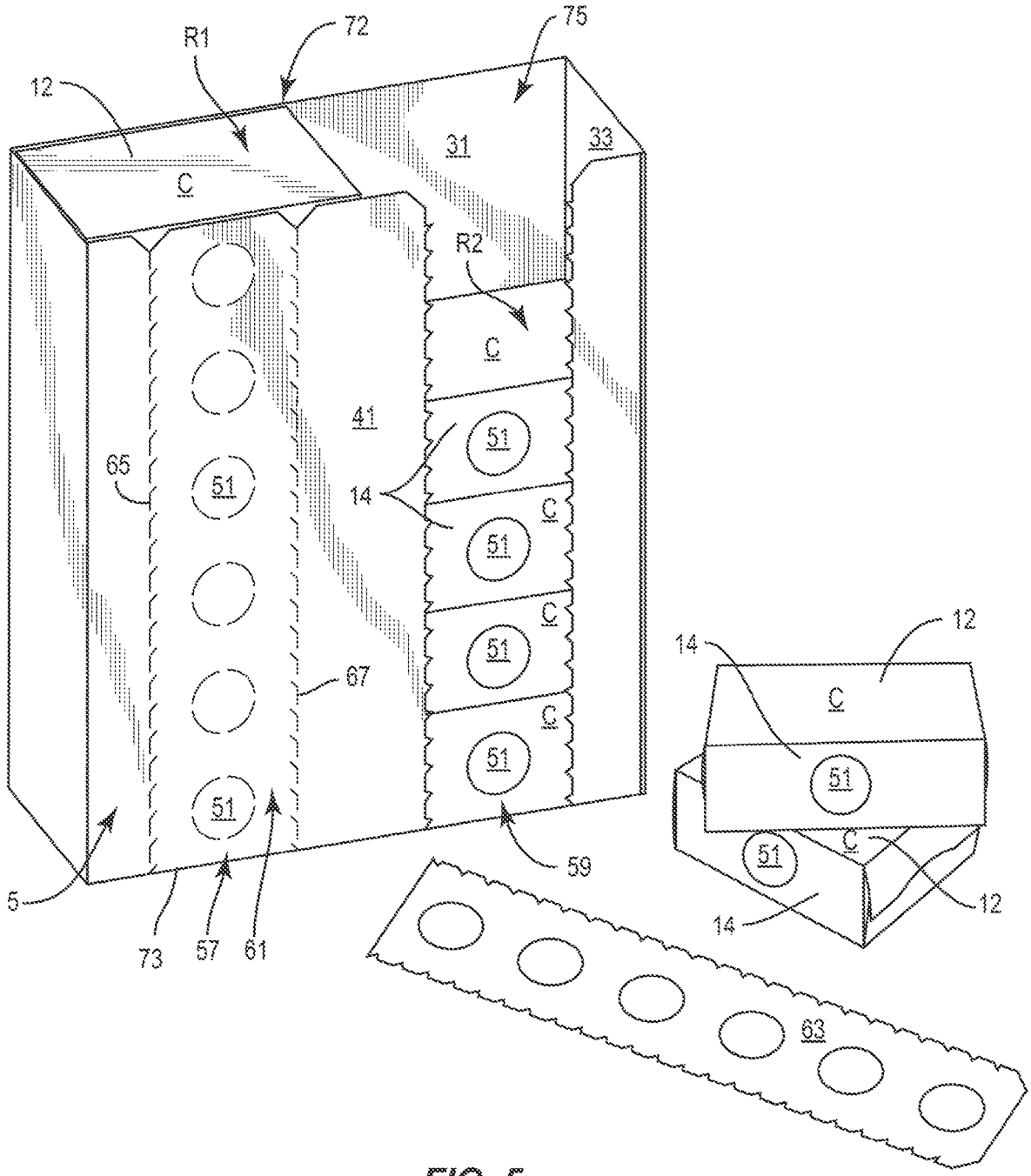
FIG. 5 is a perspective view of the package of FIGS. 3 and 4 with a dispensing feature removed according to the exemplary embodiment of the disclosure.

In one embodiment, twelve product holding containers C are contained in the construct 5 and can be arranged in two rows of six containers (e.g., a first row R1 and a second row R2 as shown in FIGS. 3-5), but more or less than twelve product holding containers can be contained in the construct and the containers can be arranged in other than two rows of six containers without departing from the disclosure. In the illustrated embodiment, the product holding containers C are illustrated as paperboard cartons C (FIG. 2B) formed by the carton blank 11 (FIG. 2A) that hold a consumer product (e.g., soap or other consumer product). The carton blank 11 has a top panel 12, a bottom panel 13, two side panels 14, 15, and end flaps 16, 17, 18, 19 for closing a first end of the carton C and second end flaps 21, 22, 23, 24 for closing a second end of the carton. As shown in FIG. 2A, the panels 12, 13, 14, 15 are foldably connected along lateral fold lines 8 and an attachment flap 27 is foldably connected to the side panel 14 along a lateral fold line 9. In the illustrated embodiment, the end flaps 16, 17, 18, 19 and 21, 22, 23, 24 are foldably connected along respective marginal portions of the carton blank 11 along respective longitudinal fold lines 10. When the product holding container C is formed, the panels 12, 13, 14, 15 are folded along the lateral fold lines 8 to extend around a container interior and the attachment flap 27 is folded along the lateral fold line 9 and adhered to an interior surface of the bottom panel 13. A product can be inserted into the container interior and the ends of the container C can be at least partially closed by folding the end flaps 16, 17, 18, 19 and 21, 22, 23, 24 along the longitudinal fold lines 10 and overlapping the end flaps. Alternatively shaped and/or configured containers C may be held in the shipping and dispensing construct 5 without departing from the disclosure.

The construct blank 3 has a longitudinal axis L1 and a lateral axis L2 and a first longitudinal edge 28 and a second longitudinal edge 30. In the illustrated embodiment, the construct blank 3 has a front panel 31 foldably connected to a first side panel 33 along a first lateral fold line 35, a second side panel 37 foldably connected to the front panel 31 along a second lateral fold line 39, and a back panel 41 foldably connected to the second side panel 37 at a third lateral fold line 43. An attachment flap 45 is foldably connected to the first side panel 33 along a fourth lateral fold line 47.

In one embodiment, the back panel 41 has attachment features in the form of attachment tabs 51 that are for receiving glue or other suitable adhesive to attach a respective container C to the shipping and dispensing construct 5. In one embodiment, each attachment tab 51 is formed by a generally circular cut 53 interrupted by four nicks 55 that facilitate connection of the attachment tab to the back panel 41. While the attachment tabs 51 and the cuts 53 are shown as being circular in the figures, the attachment tabs 51 and/or the cuts 53 could be any suitable shape without departing from the disclosure. In the illustrated embodiment, the back panel 41 includes two rows 57, 59 of six attachment tabs 51 that correspond to the two rows R1, R2 of six containers C, but the attachment tabs can be otherwise arranged to correspond to any alternative arrangement of the containers. The attachment tabs 51 can be otherwise shaped, arranged, and/or configured and/or can be formed by other lines of weakness (e.g., tear lines, cuts, etc.) without departing from the disclosure.

In one embodiment, the blank 3 includes dispensing features in the form of two tear strips 61, 63 to allow removal of a respective product holding container C from the shipping and dispensing construct 5. The first tear strip 61 is formed by two lateral tear lines 65, 67 extending across the back panel 41 from the first longitudinal edge 28 to the second longitudinal edge 30, and the second tear strip 63 is formed by two lateral tear lines 69, 71 extending across the back panel from the first longitudinal edge 28 to the second longitudinal edge 30. In one embodiment, the first tear strip 61 includes six attachment tabs 51 in the first row 57 and the second tear strip 63 includes six attachment tabs 51 in the second row 59. The attachment tabs 51 are removably attached to the tear strips 61, 63 by the nicks 55 interrupting the cuts 53, but the cuts 53 and nicks 55 could be replaced by a tear line or other line of weakening without departing from the disclosure. Accordingly, the attachment tabs 51 can be separable from the respective tear strips 61, 63 and from the back panel 41 along the respective lines of weakening (e.g., along the cuts 53 after breaking the nicks 55). Further, the tear strips 61, 63 could be otherwise shaped, arranged, and/or configured without departing from the disclosure.

In one embodiment, the shipping and dispensing construct 5 can be formed from the construct blank 3 as shown in FIGS. 3-6. The construct 5 is formed around the product holding containers C that are arranged in two rows of six containers. Glue (e.g., glue dots, beads of glue, etc.) or other adhesive can be placed on the attachment tabs 51 (e.g., by timed gluing) and applied to a respective container C, or the glue or other adhesive can be applied to a respective container prior to attachment to the blank 3 without departing from the disclosure. In the illustrated embodiment, the glue could be permanent glue or a releasable glue, such as fugitive glue, or any other suitable adhesive. The glue attaches the containers C to the shipping and dispensing construct 5 at the attachment tabs 51. Glue could be otherwise located to attach the containers C to the shipping and dispensing construct 5 at other locations/panels of the construct. After the containers C are attached to the back panel 41 at the attachment tabs 51, the second side panel 37 can be folded at the lateral fold line 43 and formed around a side of the first row R1 of containers C, the front panel 31 can be folded about the lateral fold line 39 and formed around the front of the two rows R1, R2 of containers C, and the first side panel 33 can be folded at the lateral fold line 33 and formed around a side of the second row R2 of containers C. The adhesive flap 45 can be folded at lateral fold line 47 and attached to an interior surface of the back panel 41 by glue or other adhesive. In this way, the shipping and dispensing construct 5 forms a sleeve around the two rows R1, R2 of product holding containers C having a first open end 72 at the top of the construct corresponding to the first longitudinal edge 28 of the construct blank 3 (e.g., the first longitudinal edge 28 extends along the first open end 72) and a second open end 73 at the bottom of the construct corresponding to the second longitudinal edge 30 of the blank 3 (e.g., the second longitudinal edge 30 extends along the second open end 73).

A package 75 of the present disclosure is formed by the shipping dispensing construct 5 with the product holding containers C attached to the construct. The package 75 can be shipped to a point of sale vendor (e.g., department store, grocery store, etc.) for sale to a consumer. The package 75, shipping dispensing construct 5, and/or construct blank 3 can have other features and can be alternatively shaped, arranged, and/or configured without departing from the disclosure.

In one embodiment, the product holding containers C can be dispensed from the shipping and dispensing construct 5 of the package 75 by tearing one or both of the tear strips 61, 63. For example, the tear strip 63 can be removed as shown in FIGS. 4 and 5. Upon tearing of the tear strips 61, 63, the attachment tabs 51 separate from the back panel 41 and the respective tear strip 61, 63 by tearing the nicks 55 so that the attachment tabs 51 remain attached to a respective product holding container C. When the attachment tabs 51 separate from the tear strip 61, 63 the product holding container C is released from the package 75 and the shipping and dispensing construct 5 and is free to be dispensed or removed from the shipping and dispensing construct 5. The first row R1 of product holding containers C can be dispensed from the shipping and dispensing construct 5 by removal of the first tear strip 61 and the second row R2 of product holding containers C can be dispensed from the shipping and dispensing construct by removal of the second tear strip 63 (FIG. 5). As shown in FIG. 4, the tear strips 61, 63 could be partially removed to selectively release one or more containers C so that the released containers C can be removed from the package 75 while the other containers C in that row remain attached to the back panel 41.

The tear strips 61, 63 could be removed from the package 75 in any order or could be removed at the same time by tearing along at least one of the tear lines 65, 67, 69, 71. In one embodiment, at least some of the attachment tabs 51 can be separated from the back panel 41 while one or both of the tear strips 61, 63 remains connected to at least a portion of the back panel 41 by pulling the back panel 41 away from the containers C to tear the nicks 55. For example, after the second tear strip 63 is removed as shown in FIG. 5, the first tear strip 61 could be removed by tearing along at least one of the tear lines 65, 67 in a similar manner to the second tear strip 63, or the first tear strip 61 could remain attached to the remainder of the construct 5 shown in FIG. 5 and the containers C in the first row R1 can be released from the package 75 by pulling the remainder of the construct 5 away from the containers C to separate the attachment tabs 51 from the back panel 41. The package 75 and the shipping and dispensing construct 5 could have other dispensing features or the dispensing features could be otherwise shaped, arranged, and/or configured without departing from the disclosure.

In an exemplary embodiment, the package 75 of the present disclosure has a shipping and dispensing construct 5 comprising paperboard material that is attached to the product holding containers C and eliminates and/or reduces the use of plastic over wrap around the product holding containers. The front panel 31 provides a suitable surface for graphics such as advertising or other indicia, and the back panel 41 has the release features for allowing selective dispensing of one or more of the product holding containers C from the shipping and dispensing construct 5.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A shipping and dispensing construct for a plurality of product holding containers, the shipping and dispensing construct comprising:

a plurality of panels defining an interior of the shipping and dispensing construct, the plurality of panels comprising a front panel, a first side panel, a back panel, and a second side panel, wherein the plurality of product holding containers are positioned within the interior;

wherein the back panel includes a tear strip defined between two strip lines of weakening;

wherein the back panel includes a plurality of attachment tabs positioned between the two strip lines of weakening and attached to the tear strip with respective tab lines of weakening, wherein each attachment tab is secured to a respective product holding container of the plurality of product holding containers;

wherein the shipping and dispensing construct is arranged to be converted from a shipping configuration to a dispensing configuration via at least partial removal of the tear strip from the back panel;

wherein in the shipping configuration, the tear strip secures the plurality of product holding containers within the interior of the shipping and dispensing construct by coupling each of the plurality of product holding containers to the back panel; and wherein in the dispensing configuration, the tear strip is detached from at least one attachment tab of the plurality of tabs by at least partially removing the tear strip from the back panel along the two strip lines of weakening, the at least partial removal of the tear strip decoupling at least one of the plurality of product holding containers from the back panel and exposing the at least one of the plurality of product holding containers between the strip lines of weakening such that the at least one of the plurality of product holding containers is removable from the interior, the plurality of panels define a sleeve having a first open end defining a top of the shipping and dispensing construct and a second open end defining a bottom of the shipping and dispensing construct, the at least one of the plurality of product holding containers is removable from the interior via the first open end when the tear strip is detached from the at least one of the plurality of attachment tabs.

2. The shipping and dispensing construct of claim 1, wherein each of the tab lines of weakening form closed shapes.

3. The shipping and dispensing construct of claim 1, wherein each of the strip lines of weakening and each of the tab lines of weakening comprises a cut interrupted by a plurality of nicks.

4. The shipping and dispensing construct of claim 1, wherein in the dispensing configuration with the tear strip is completely detached from the back panel, the back panel comprises two edges extending along the two strip lines of weakening.

5. The shipping and dispensing construct of claim 1, wherein each of the plurality of panels has a respective first free edge extending along the first open end and each of the plurality of panels has a respective second free edge extending along the second open end.

6. The shipping and dispensing construct of claim 5, wherein the strip lines of weakening extend across the back panel from the first free edge of the back panel to the second free edge of the back panel.

7. A blank for forming a shipping and dispensing construct for a plurality of product holding containers, the blank comprising:

a plurality of panels including a front panel, a first side panel, a back panel, and a second side panel arranged to define an interior of the shipping and dispensing construct;

wherein the back panel includes a tear strip defined between two strip lines of weakening;

wherein the back panel includes a plurality of attachment tabs positioned between the two strip lines of weakening and attached to the tear strip with respective tab lines of weakening, wherein each attachment tab is secured to a respective product holding container of the plurality of product holding containers;

wherein the shipping and dispensing construct is arranged to be converted from a shipping configuration to a dispensing configuration via at least partial removal of the tear strip from the back panel;

wherein in the shipping configuration, the tear strip secures the plurality of product holding containers within the interior of the shipping by coupling each of the plurality of product holding containers to the back panel; and wherein in the dispensing configuration, the tear strip is detached from at least one of the plurality of attachment stab by at least partially removing the tear strip from the back panel along the two strip lines of weakening, the at least partial removal of the tear strip decoupling at least one of the plurality of product holding containers from the back panel and exposing the at least one of the plurality of product holding containers between the two strip lines of weakening such that the at least one of the plurality of product holding containers is removable from the interior, the plurality of panels are for defining a sleeve having a first open end defining a top of the shipping and dispensing construct formed from the blank and a second open end defining a bottom of the shipping and dispensing construct formed from the blank, the at least one of the plurality of product holding containers is removable from the interior via the first open end when the tear strip is detached from the at least one of the plurality of attachment tabs.

8. The blank of claim 7, wherein each of the tab lines of weakening form closed shapes.

9. The blank of claim 7, wherein each of the strip lines of weakening and each of the tab lines of weakening comprises a cut interrupted by a plurality of nicks.

10. The blank of claim 7, comprising a first longitudinal edge defining a respective first free edge of each of the plurality of panels for extending along the first open end and second longitudinal edge defining a respective second free edge of each of the plurality of panels for extending along the second open end.

11. The blank of claim 10, wherein the strip lines of weakening extend across the back panel from the first free edge of the back panel to the second free edge of the back panel.

12. A package comprising:

a shipping and dispensing construct that has a shipping configuration and a dispensing configuration, the construct comprising a plurality of panels including a front panel, a first side panel, a back panel, and a second side panel, wherein the front panel and the back panel are each connected to the first side panel and the second side panel, defining an interior; and a plurality of product holding containers disposed in the interior;

wherein when in a shipping configuration:

the back panel includes a tear strip defined between two strip lines of weakening; and the tear strip includes a plurality of attachment tabs defined within respective tab lines of weakening, wherein each attachment tab is attached to a respective product holding container of the plurality of product holding containers;

wherein when in a dispensing configuration:

the tear strip is detached from at least one of the plurality of attachment tabs while simultaneously at least partially removing the tear strip from the back panel along the two strip lines of weakening, the at least partial removal of the tear strip decoupling at least one of the plurality of product holding containers from the back panel and exposing the at least one of the plurality of product holding containers between the two strip lines of weakening such that the at least one product holding container is removable from the interior, the plurality of panels define a sleeve having a first open end defining a top of the shipping and dispensing construct and a second open end defining a bottom of the shipping and dispensing construct, the at least one of the plurality of product holding containers is removable from the interior via the first open end when the tear strip is detached from the at least one of the plurality of attachment tabs.

13. The package of claim 12, wherein each attachment tab of the plurality of attachment tabs is separable from the tear strip along a respective tab line of weakening.

14. The package of claim 12, wherein each of the strip lines of weakening and each of the tab lines of weakening comprises a cut interrupted by a plurality of nicks.

15. The package of claim 12, wherein the tear strip can be partially removed to release a desired number of the plurality of product holding containers from the shipping and dispensing construct.

16. The package of claim 12, wherein each of the plurality of panels has a respective first free edge extending along the first open end and each of the plurality of panels has a respective second free edge extending along the second open end.

17. The package of claim 16, wherein the strip lines of weakening extend across the back panel from the first free edge of the back panel to the second free edge of the back panel.

* * * * *